US007980555B2

(12) United States Patent
Asada et al.

(10) Patent No.: US 7,980,555 B2
(45) Date of Patent: Jul. 19, 2011

(54) SHEET GUIDE APPARATUS AND IMAGE FORMING APPARATUS

(75) Inventors: Tetsuo Asada, Nagoya (JP); Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 239 days.

(21) Appl. No.: 11/616,310

(22) Filed: Dec. 27, 2006

(65) Prior Publication Data

US 2007/0183832 A1 Aug. 9, 2007

(30) Foreign Application Priority Data

Dec. 28, 2005 (JP) ..... 2005-380146

(51) Int. Cl.
*B65H 1/00* (2006.01)

(52) U.S. Cl. ..... 271/171; 271/145

(58) Field of Classification Search ..... 271/171, 271/145

See application file for complete search history.

(56) References Cited

U.S. PATENT DOCUMENTS

| | | | | |
|---|---|---|---|---|
| 4,032,136 | A * | 6/1977 | Komaba et al. | 271/160 |
| 4,874,159 | A * | 10/1989 | Maeno et al. | 271/171 |
| 6,523,822 | B1 * | 2/2003 | Galtier et al. | 271/171 |
| 6,916,020 | B2 * | 7/2005 | Hasegawa | 271/171 |
| 6,926,269 | B2 * | 8/2005 | Ishikuro | 271/171 |
| 7,052,197 | B2 * | 5/2006 | Bowen et al. | 400/624 |
| 2006/0082044 | A1 * | 4/2006 | Aida | 271/145 |

FOREIGN PATENT DOCUMENTS

| | | |
|---|---|---|
| JP | H59212331 | 12/1984 |
| JP | H331150 | 3/1991 |
| JP | H6234432 | 8/1994 |
| JP | H11130273 | 5/1999 |
| JP | 2002255361 | 9/2002 |

* cited by examiner

*Primary Examiner* — Stefanos Karmis
*Assistant Examiner* — Ernesto Suarez
(74) *Attorney, Agent, or Firm* — Baker Botts L.L.P.

(57) ABSTRACT

A sheet guide apparatus including a sheet tray in which a sheet is placed and a side guide having an abutting portion that abuts the sheet placed in the sheet tray. The sheet tray includes a groove formed along a direction perpendicular to an abutting surface of the abutting portion against the sheet. The side guide includes a sliding portion having slidable portions slidable on side walls of the groove, and is capable of moving along a groove direction when the sliding portion is slid on the side walls. The groove includes at least one first groove area and at least one second groove area. The second groove area has a groove width smaller than a groove width of the first groove area and allows the slidable portions of the sliding portion to be slid in the second groove area.

20 Claims, 9 Drawing Sheets

SHEET GUIDE APPARATUS AND IMAGE FORMING APPARATUS

CROSS-REFERENCE TO RELATED APPLICATIONS

This application claims the benefit of Japanese Patent Application No. 2005-380146 filed Dec. 28, 2005 in the Japanese Patent Office, the disclosure of which is incorporated herein by reference.

BACKGROUND

The present inventions relates to a sheet guide apparatus for placing a sheet in a predetermined orientation and guiding conveyance of the sheet, and relates to an image forming apparatus provided with the sheet guide apparatus.

A typical conventional image forming apparatus for forming an image on a sheet is provided with a sheet guide apparatus including a sheet tray. A known sheet guide apparatus is designed to allow various types of sheets, such as a JIS (JIS: Japanese Industrial Standards) B5 size sheet and a JIS A4 size sheet having different sheet widths, to be placed with a specified orientation and be guided in the conveying direction.

An example of such a sheet guide apparatus includes a side guide that abuts an edge of a sheet placed in a sheet tray thereby to place the sheet in a predetermined orientation and guide conveyance of the sheet. The side guide is required to be capable of abutting an edge of each sheet having a different size, and thus is required to be easily moved in a direction perpendicular to the edge of the sheet. The side guide is also required to allow placement of the sheet in the predetermined orientation and not to deviate, in order to prevent the sheet from obliquely traveling during a sheet conveyance.

A proposed sheet guide apparatus includes a side guide that is capable of abutting an edge of a sheet parallel with a sheet conveying direction. The sheet guide apparatus includes a sheet tray provided with a guide groove having a constant width and extending in a direction perpendicular to the sheet conveying direction. An elastic deformation portion is provided along the guide groove. The sheet tray also includes a plurality of elongated holes provided along the elastic deformation portion and on an opposite side of the guide groove with the elastic deformation portion located therebetween. A guiding projection extending in the guide groove and having a width slightly larger than a width of the guide groove projects from an undersurface of the side guide.

SUMMARY

In the above-described sheet guide apparatus, sliding of the guiding projection on side walls of the guide groove results in elastic deformation of the elastic deformation portion and thus expansion of the width of the guide groove. Thereby, the side guide can be easily moved. Also, the side guide can be retained by an elastic force of the elastic deformation portion to recover to an original state.

However, the sheet guide apparatus involves the following problems.

Specifically, the sheet tray made of synthetic resin is subject to creep deformation and expansion of the width of the guiding groove due to a long-time use. A size of a sheet depends on a type of the sheet, and the guiding projection of the side guide is retained in the guide groove at a specific position corresponding to the size of the sheet for a long time period. Accordingly, the width of the guide groove is expanded at the specific position corresponding to the size of the sheet. Once the width of the guide groove is expanded, the sheet is likely to be deviated and obliquely conveyed during sheet conveyance.

Also, it is difficult to provide an appropriate elasticity to the side guide to avoid wobbling of the side guide while allowing easy sliding of the side guide on the side walls of the guide groove by forming the plurality of elongated holes. Further, the sheet guide apparatus may not be manufactured easily.

One aspect of the present invention may provide a sheet guide apparatus in which a sheet may be placed in a predetermined orientation and oblique traveling of the sheet during sheet conveyance may be suppressed. A sheet tray for the sheet guide apparatus may preferably be manufactured easily.

In the one aspect of the present invention, there is provided a sheet guide apparatus which includes a sheet tray in which a sheet is placed and a side guide having at least one abutting portion that abuts one of edges of the sheet placed in the sheet tray.

The sheet tray includes a groove formed along a direction perpendicular to an abutting surface of the abutting portion against the sheet. The side guide includes a sliding portion having slidable portions slidable on a pair of opposed side walls of the groove, and is capable of moving along a groove direction as a longitudinal direction of the groove when the sliding portion is slid on the side walls. The groove includes at least one first groove area and at least one second groove area. The second groove area has a groove width smaller than a groove width of the first groove area and allows the slidable portions of the sliding portion to be slid in the second groove area.

Accordingly, wobbling of the sliding portion and thus of the side guide may be suppressed when the sliding portion is located in the second groove area.

BRIEF DESCRIPTION OF THE DRAWINGS

Preferred embodiments of the present invention will be described hereinafter with reference to the drawings, in which.

DETAILED DESCRIPTION OF THE PREFERRED EMBODIMENTS

Figure 1:
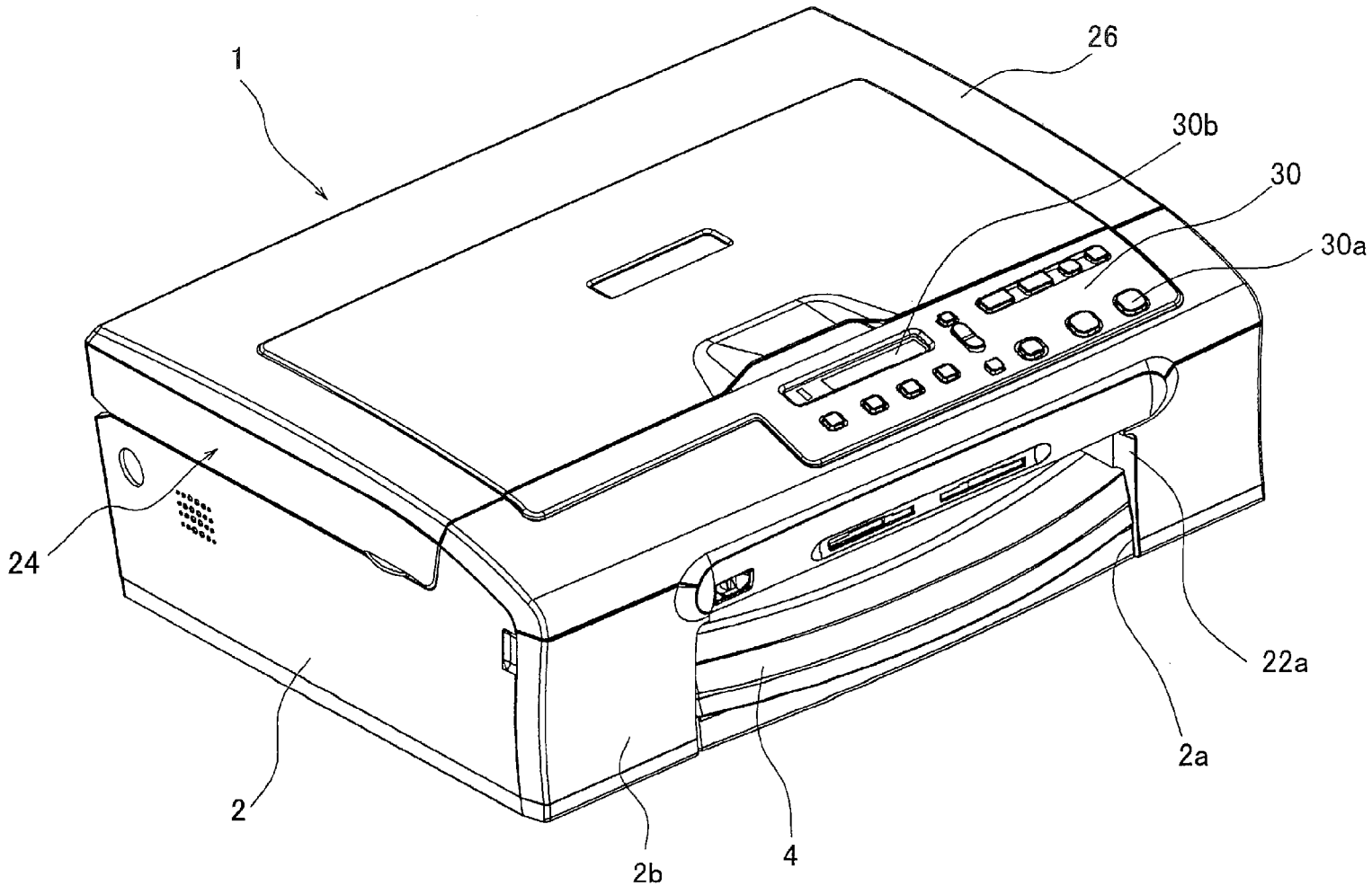
FIG. 1 is a perspective view of an image forming apparatus provided with an inkjet recording head as an embodiment of the present invention.

An image forming apparatus 1 in the present embodiment is a multifunction device (MFD: Multi Function Device) provided with a printer function, a copier function, a scanner function, and a facsimile function. As shown in FIG. 1, the image forming apparatus 1 includes a housing 2 which is injection-molded from a synthetic resin.

A sheet tray 4 located in a bottom of the housing 2 is detachable and attachable through an opening 2*a* formed in a front portion 2*b* of the housing 2. The sheet tray 4 is capable of containing a plurality of sheets P in a stacked manner with a shorter side of each sheet P extending in parallel with a direction perpendicular to a sheet conveying direction. The sheets P may be of, for example, JIS (Japanese Industrial Standards) A4 size, letter size, JIS B5 size, postcard size, etc.

Figure 2:
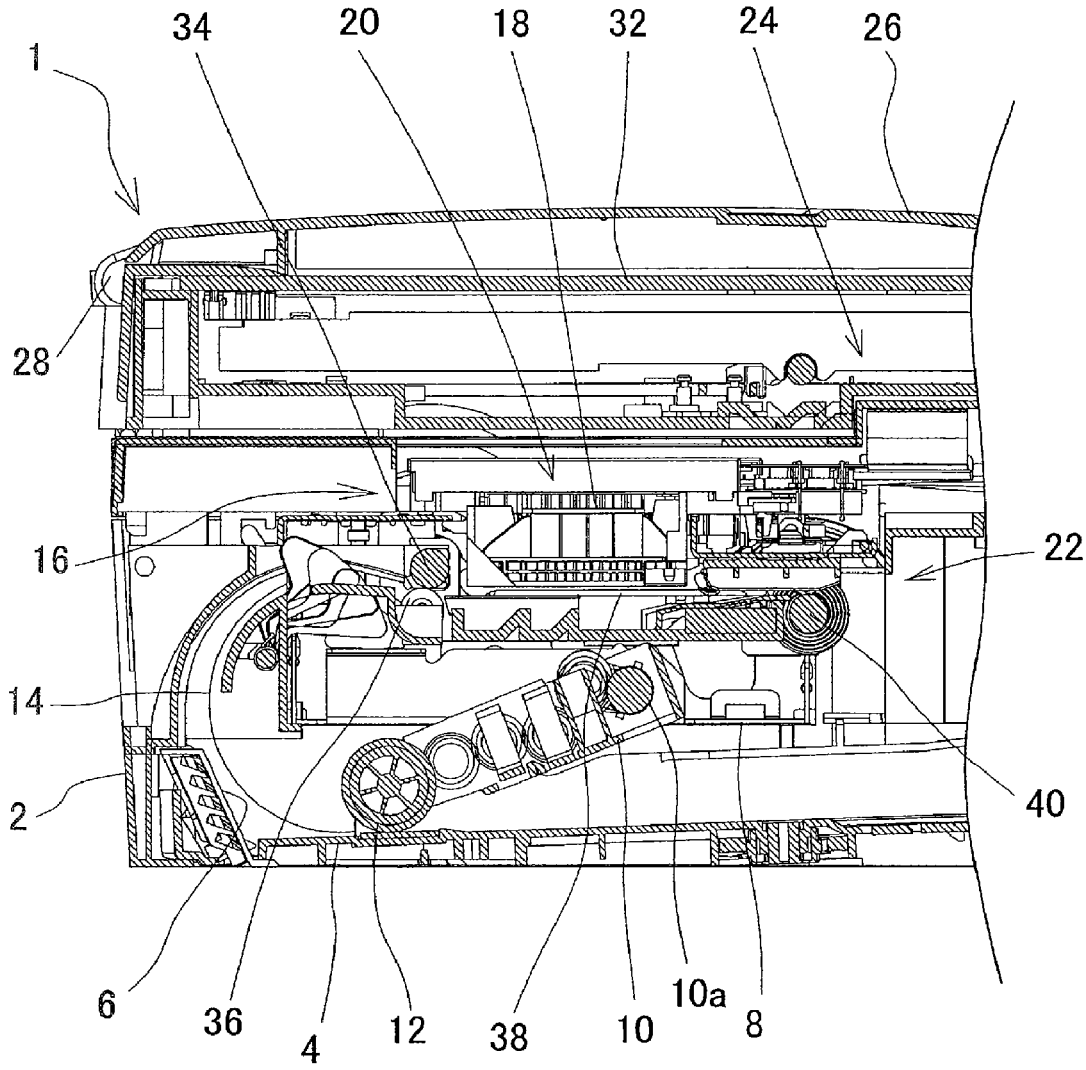
FIG. 2 is a cross-sectional view showing a rear portion of an inside of the image forming apparatus in the present embodiment.

As shown in FIG. 2, a blank portion 6 for separating sheets is disposed in a back portion of the sheet tray 4. A box-shaped main frame 8 is housed in the image forming apparatus 1. A sheet feed arm 10 is fixed to the main frame 8 at a proximal end portion 10*a* of the sheet feed arm 10 so as to be upwardly and downwardly pivotable around the proximal end portion 10*a*.

A sheet feed roller 12, which is provided at a distal end portion of the sheet feed arm 10, and the bank portion 6 separate and convey the sheets P stacked in the sheet tray 4 sheet by sheet. Each separated sheet P is fed from a back of the sheet tray 4 to a printing mechanism 16 provided above the sheet tray 4 through a U-turn path (a feeding path) 14. The printing mechanism 16 includes a reciprocable carriage 20 on which a recording head 18 of inkjet type is mounted.

A sheet discharge portion 22 is disposed above the sheet tray 4. The sheet P after image formation (hereinafter also referred to as "printing") by the printing mechanism 16 is discharged to the discharge portion 22 with a printed face up. A sheet discharge port 22*a* communicating with the sheet discharge portion 22 is opened so as to be integrated with the opening 2*a* in the front portion 2*b* of the housing 2.

An image scanner 24 to be used for document scanning in the copier function or the facsimile function is disposed over the housing 2. A rear end of a document cover 26 to cover all over an image scanning surface 32 of the image scanner 24 is attached to a rear end of the image scanner 24 so as to be pivotable upwardly and downwardly around an axis 28.

As shown in FIG. 1, an operation panel 30 is disposed in a front portion of the image scanner 24. The operation panel 30 includes a variety of operation buttons 30*a*, a liquid crystal display 30*b* and others.

A driving regist roller 34 and a following regist roller 36 are provided for conveying the sheet P to a position under the recording head 18. The driving regist roller 34 and the following regist roller 36 are disposed upstream from a platen 38 in the sheet conveying direction. A sheet discharge roller 40 for conveying the sheet P after printing to the sheet discharge portion 22 is disposed downstream from the platen 38.

The image forming apparatus 1 of the present embodiment provides an intermittent sheet feed mode and a continuous sheet fed mode. Specifically, the sheets P are conveyed intermittently sheet by sheet for image formation thereon in the intermittent sheet feed mode, while the sheets P are conveyed continuously for image formation thereon in the continuous sheet feed mode.

The intermittent sheet feed mode is a conveyance mode to be selected to perform color printing of, for example, a color photo image. When inks of multiple colors are ejected onto the sheet P to form an image thereon in fine dots, a leading edge of the sheet P to be conveyed is temporarily stopped by the regist rollers 34 and 36. This is to eliminate an oblique movement of the sheet P and to adjust a conveyance position of the sheet P to a printing position of the recording head 18. As a result, occurrence of color shifts or unevenness in color may be suppressed.

Figure 3A:
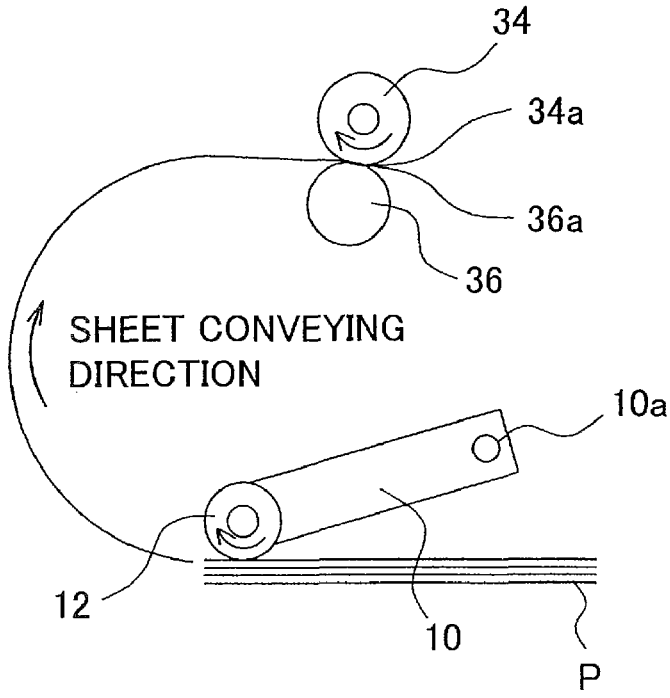
FIG. 3A is an explanatory view for illustrating separation conveyance of a sheet in an intermittent sheet feed mode.

Specifically, in the intermittent sheet feed mode, as shown in FIG. 3A, the driving regist roller 34 is rotated by a not-shown drive motor in a direction opposite to the sheet conveying direction (i.e., rotated in a clockwise direction in FIG. 3A). On the other hand, the sheet feed roller 12 is rotated in the sheet conveying direction (i.e., rotated in the clockwise direction in FIG. 3A).

Accordingly, an uppermost sheet P is separated from the sheets, P stacked in the sheet tray 4 and is conveyed in the sheet conveying direction by the sheet feed roller 12. Since the driving regist roller 34 is rotated in the direction opposite to the sheet conveying direction, a leading edge of the uppermost sheet P strikes nip portions 34*a* and 36*a* of the respective regist rollers 34 and 36, and is temporarily stopped. Then, an oblique movement of the uppermost sheet P may be corrected.

Figure 3B:
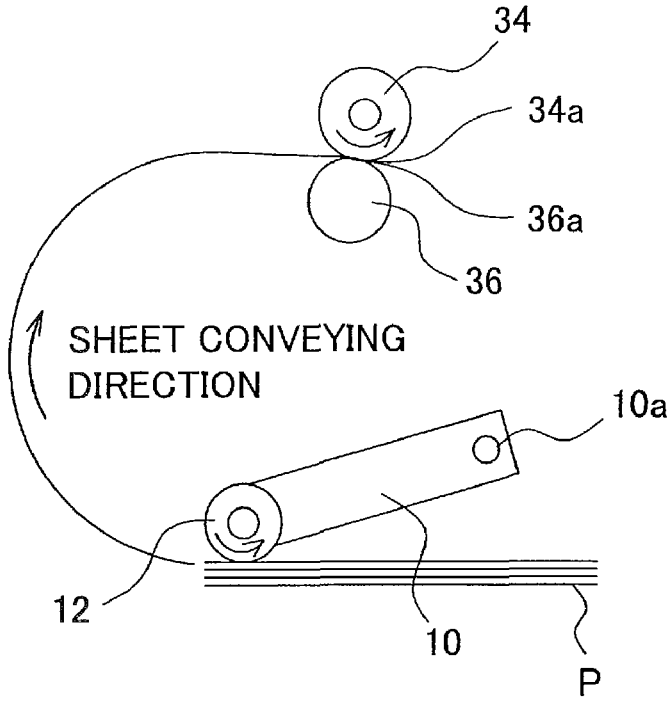
FIG. 3B is an explanatory view for illustrating a leading edge positioning operation in the intermittent sheet feed mode.

Subsequently, as shown in FIG. 3B, the driving regist roller 34 is rotated in the sheet conveying direction (i.e., rotated in a counterclockwise direction in FIG. 3B). On the other hand, the sheet feed roller 12 is rotated in a direction opposite to the sheet conveying direction (i.e., rotated in the counterclockwise direction in FIG. 3B). By this, the uppermost sheet P may be conveyed by a predetermined amount to a specified position. That is, a leading edge positioning operation is performed.

When printing is performed, the driving regist roller 34 is rotated in the sheet conveying direction, while the sheet feed roller 12 is rotated in a direction opposite to the sheet conveying direction, thereby feeding the uppermost sheet P in the sheet conveying direction. At the same time, the sheet feed arm 10 pivots in a swinging manner around the proximal end portion 10*a*, that is, performs a release operation.

Once printing of the uppermost sheet P is completed, the above described process is repeatedly performed for each of the plurality of sheets P. Thus, intermittent conveyance and printing of the plurality of sheets P is performed.

The continuous sheet feed mode is a conveyance mode to be selected when priority is placed on an image forming speed rather than on an image quality. In the continuous sheet feed mode, the plurality of sheets P are continuously conveyed from the sheet tray 4.

Figure 4:
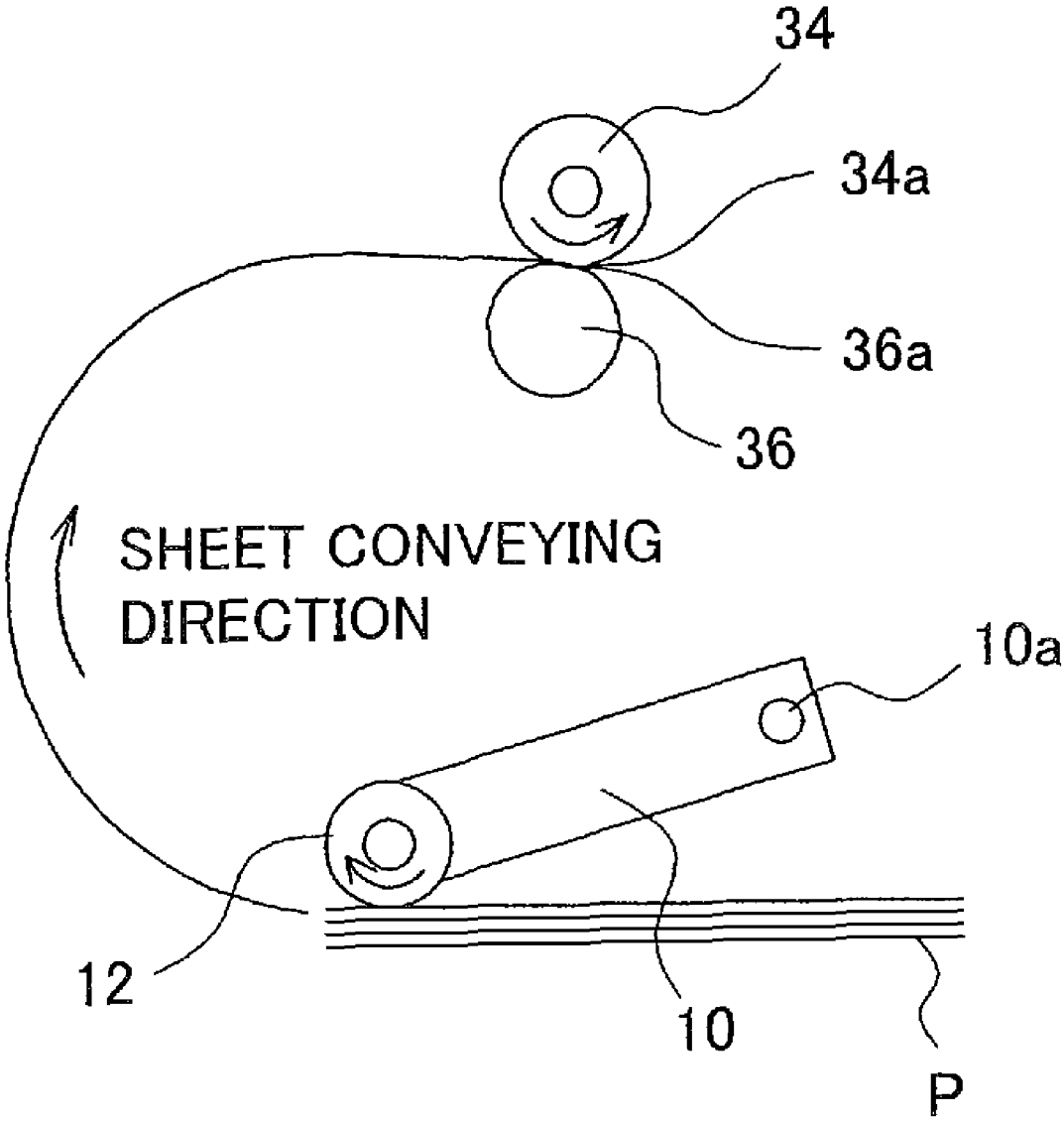
FIG. 4 is an explanatory view for illustrating a continuous sheet feed mode.

Specifically, in the continuous sheet feed mode, as shown in FIG. 4, the driving regist roller 34 is rotated by the not-shown drive motor in the sheet conveying direction (i.e., rotated in a counterclockwise direction in FIG. 4). The sheet feed roller 12 is rotated in the sheet conveying, direction (i.e., rotated in the clockwise direction in FIG. 4). In this case, a peripheral speed of the driving regist roller 34 is set to be greater than a peripheral speed of the sheet feed roller 12.

An uppermost sheet P is separated from the sheets P stacked in the sheet tray 4 and is conveyed in the sheet conveying direction by the sheet feed roller 12. The uppermost sheet P is sandwiched and conveyed by the nip portions 34*a* and 36*a* of the respective regist rollers 34 and 36.

In the continuous sheet feed mode, the driving regist roller 34 and the sheet feed roller 12 are continuously rotated in the sheet conveying direction during printing without temporarily stopping the uppermost sheet P by the regist rollers 34 and 36. Since the plurality of sheets P are thus continuously conveyed, high speed printing may be achieved.

A detailed description will now be provided about the sheet tray 4 applied to the image forming apparatus 1 of the present embodiment.

Figure 5:
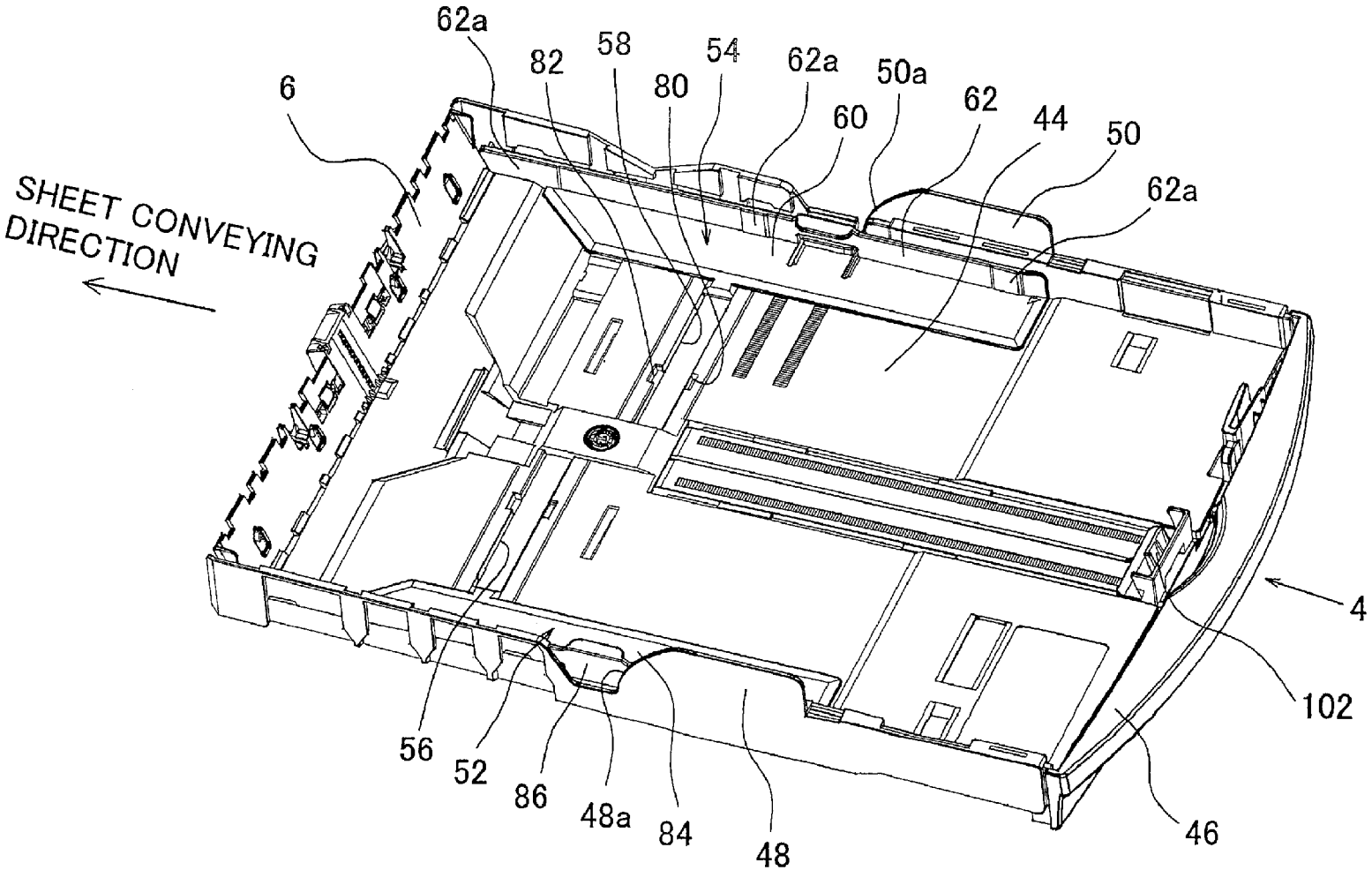
FIG. 5 a perspective view of a sheet tray.

As shown in FIG. 5, the sheet tray 4 in the present embodiment has an upwardly open boxed-shaped configuration. The sheet tray 4 includes a substantially rectangular bottom wall 44, and the above-mentioned bank portion 6, a handle portion 46, a left side wall 48 and a right side wall 50, which are arranged so as to surround a periphery of the bottom wall 44. The sheet tray 4 is capable of containing, in a stacked manner, sheets P of one of a plurality of sizes, such as letter size, JIS A4 size and JIS B5 size.

The bank portion 6 extends from an end portion of the bottom wall 44 along the end portion in the sheet conveying direction of the sheets P. The handle portion 46 is erected from the bottom wall 44 along an end portion of the bottom wall 44 on a side opposite to the sheet conveying direction of the sheets P (i.e., on a front side of the image forming apparatus 1).

A left side wall 48 and a right side wall 50 are erected from the bottom wall 44 so as to be respectively parallel with the sheet conveying direction of the sheets P. Here, the left side wall 48 is provided at a left side end of the bottom wall 44 when the image forming apparatus 1 is seen from a front direction (hereinafter also simply referred to as a "left side"). The right side wall 50 is provided at a right side end when the image forming apparatus 1 is seen from a front direction (hereinafter also simply referred to as a "right side"). The sheets P contained in the sheet tray 4 in the stacked manner are thus surrounded or covered by the bank portion 6, the handle portion 46, the left side wall 48 and the right side wall 50, leaving only an upper face opened.

In the sheet tray 4, a left, side guide 52 and a right side guide 54 are disposed. The left side guide 52 and the right side guide 54 have symmetrical configurations with each other. A pair of elongated rectangular grooves 56 and 58 are formed in the bottom wall 44 along the direction perpendicular to the sheet conveying direction of the sheets P so as to penetrate to a reverse surface of the bottom wall 44. The direction perpendicular to the sheet conveying direction of the sheets P is hereinafter referred to as a "groove direction".

A detailed description will be provided hereinafter about the right side guide 54 and the groove 58.

Figure 6:
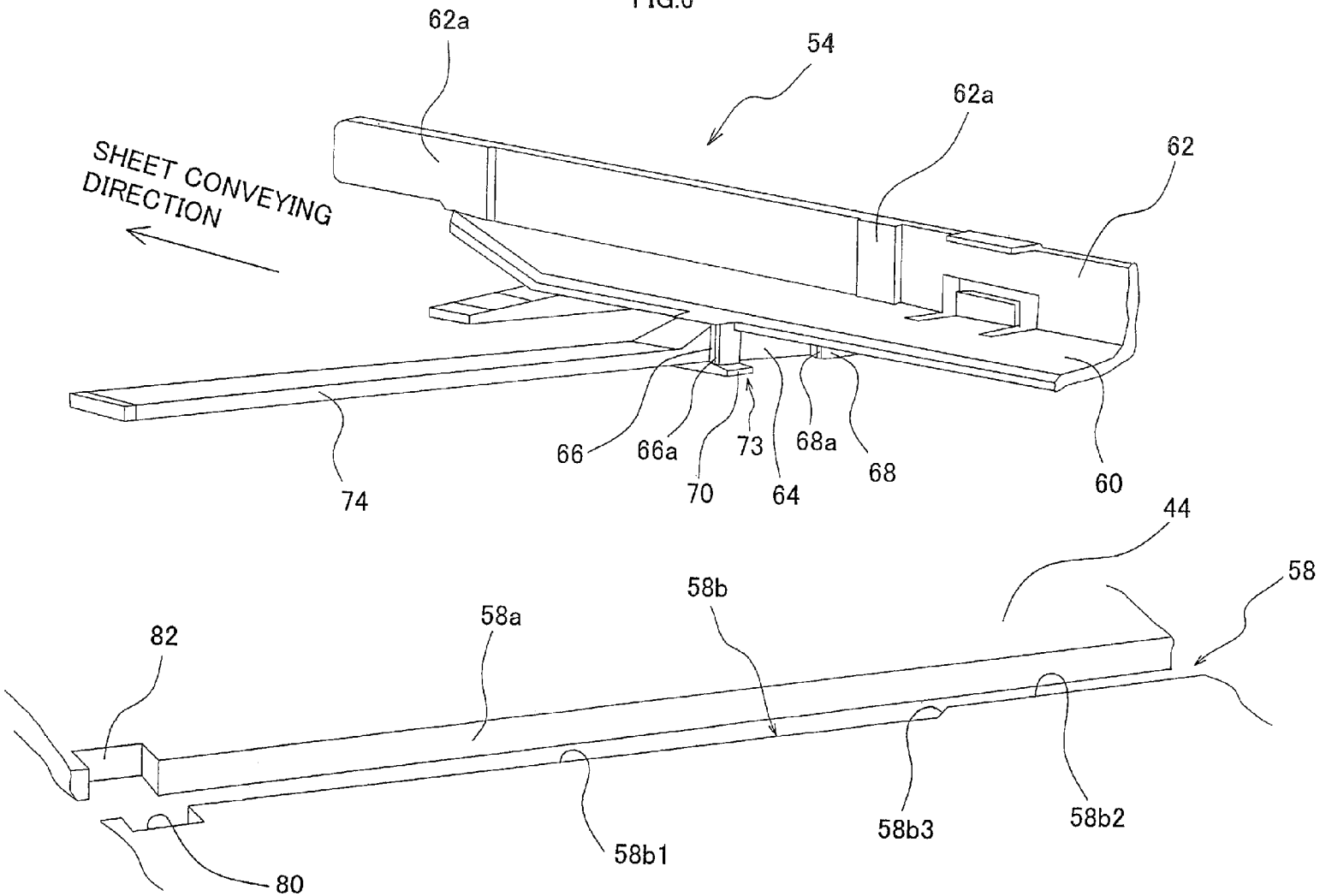
FIG. 6 is an exploded perspective view showing a right side guide and a groove formed in a bottom wall.

As shown in FIG. 5 and FIG. 6, the right side guide 64 includes a horizontal wall 60 and a plate member, e.g., a vertical wall 62. The horizontal wall 60 is in parallel with the bottom wall 44, and the sheets P are placed thereon. The vertical wall 62 is erected vertically from the horizontal wall 60. At least one sheet abutting portion 62*a* (three in the present embodiment) projects from an inner surface of the vertical wall 62 so as to contact a side surface of the sheet(s) P parallel with the sheet conveying direction.

Figure 7:
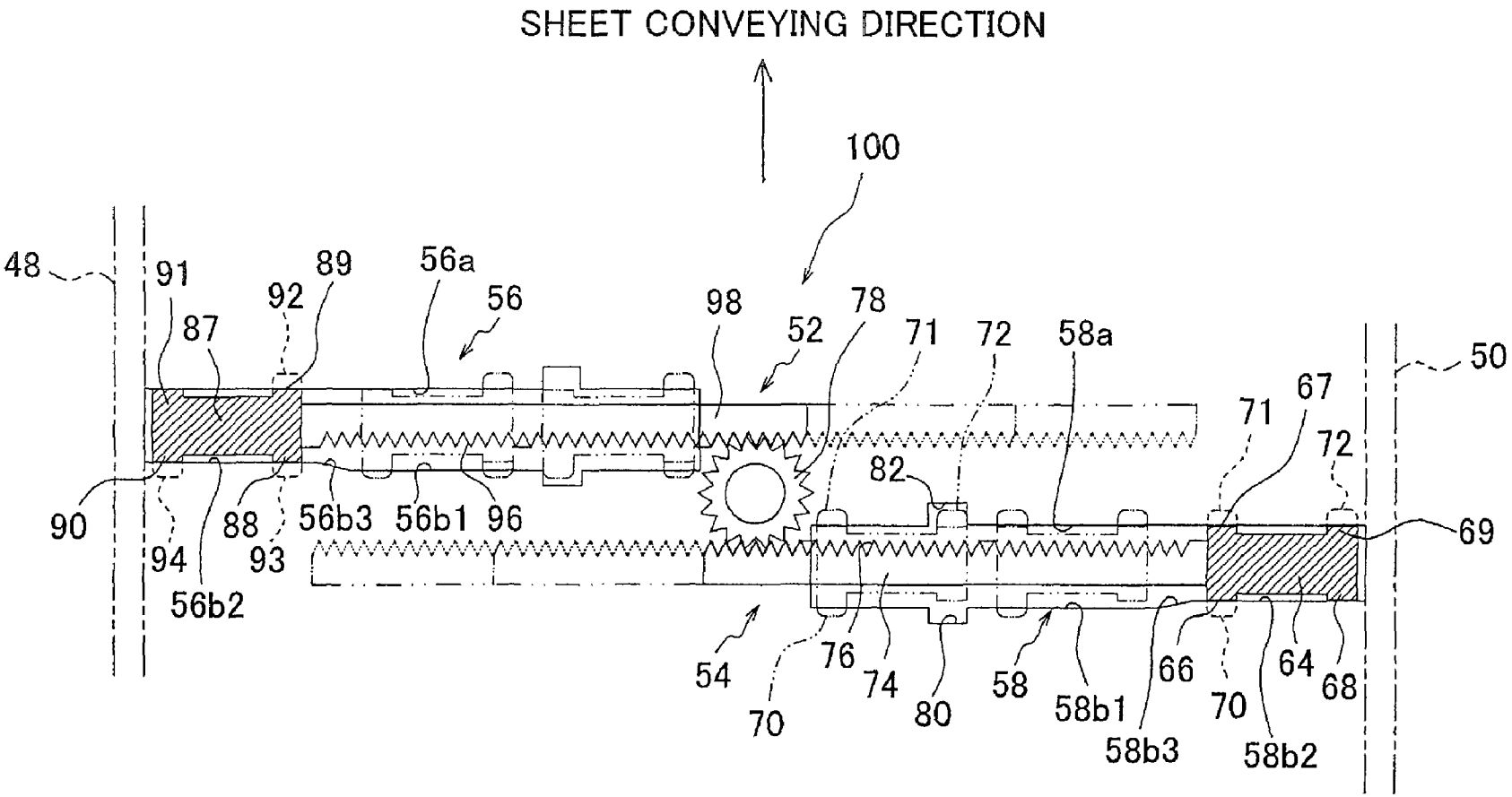
FIG. 7 is an enlarged cross-sectional view showing a relationship between sliding portions of side guides and grooves in the present embodiment.

The horizontal wall 60 includes a sliding portion 64 on a side of the bottom wall 44, i.e., in a lower portion of the horizontal wall 60. The sliding portion 64 is configured to be insertable into the groove 58 located on the right side in the pair of grooves 56 and 58 formed in the bottom wall 44. As shown in FIG. 7, the sliding portion 64 has a substantially rectangular cross-section corresponding to a configuration of the groove 58.

The sliding portion 64 includes four protruding potions 66-69 at both longitudinal ends. Each two of the protruding potions 66-69 are separate from each other in the groove direction and project from each surface of the sliding portion 64 to face each of side walls 58*a* and 58*b* (i.e., later-described front inner wall 58*a* and back inner wall 58*b*) of the groove 58 when inserted in the groove 58.

Figure 8:
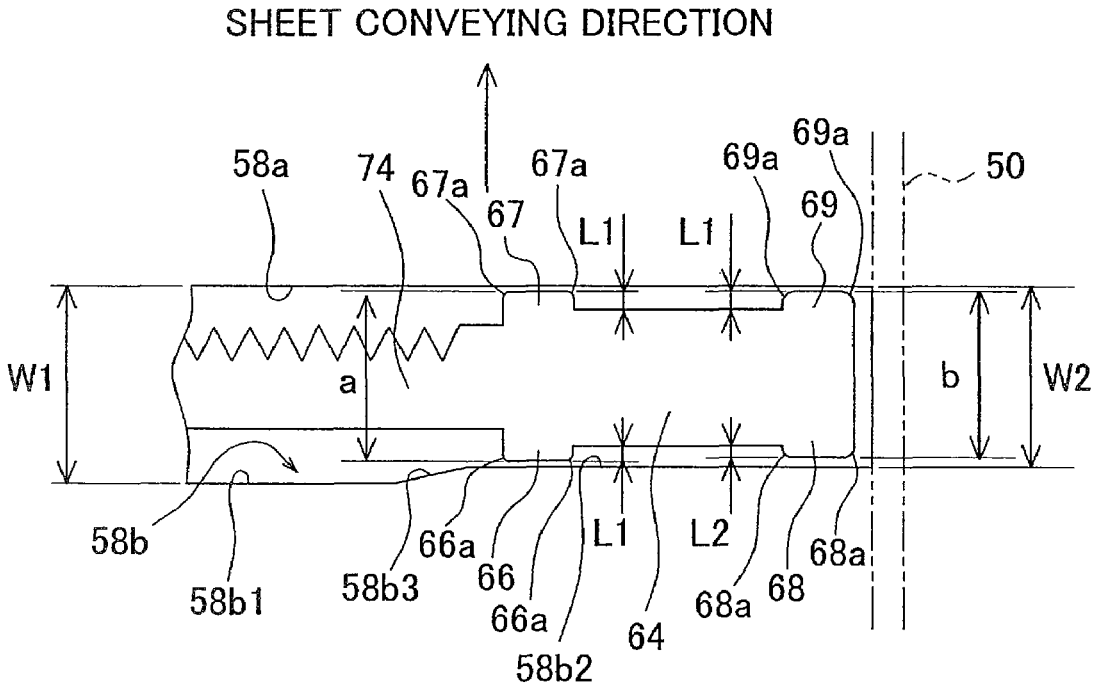
FIG. 8 is an enlarged explanatory view showing a relationship between protruding amounts of protruding potions of the sliding portion of the right side guide in the present embodiment and a width of the groove.

The above-configured sliding portion 64 is inserted into the groove 58 such that the four protruding potions 66-69 are slidable on the side walls 58*a* and 58*b* of the groove 58 as shown in FIG. 7 and FIG. 8.

The groove 58 having a substantially rectangular cross-section includes a pair of the side walls 58*a* and 58*b*, i.e., a front inner wall 58*a* and a back inner wall 58*b* facing each other. The front inner wall 58*a* located forward in the sheet conveying direction is configured to be flat in a straight line along the groove direction.

The back inner wall 58*b* located backward in the sheet conveying direction includes a first inner wall 58*b*1, a second inner wall 58*b*2 and an oblique inner wall 58*b*3. The first inner wall 58*b*1 is configured to provide a largest distance (hereinafter also referred to as a "first width W1") from the front inner wall 58*a*. The second inner wall 58*b*2 is configured to provide a distance (hereinafter also referred to as a "second width W2") from the front inner wall 58*a*, which is smaller than the first width W1. The oblique inner wall 58*b*3 connects the first inner wall 58*b*1 and the second inner wall 58*b*2. A difference between the first width W1 and the second width W2 is approximately 0.1 mm in the present embodiment.

The second inner wall 58*b*2 is designed such that the sliding portion 64 is located between the front inner wall 58*a* and the second inner wall 58*b*2 when the vertical wall 62 of the right side guide 54 is located in a position corresponding to a width of sheets P of at least one size among the sheets P of the plurality of sizes.

Specifically, in the present embodiment, the second inner wall 58*b*2 is designed such that the sliding portion 64 is located between the front inner wall 58*a* and the second inner wall 58*b*2 when the vertical wall 62 of the right side guide 54 is located in a position corresponding to a relatively large width of sheets P of A4 size or letter size among the sheets P of the plurality of sizes.

Accordingly, the first inner wall 58*b*1 is formed in a portion of the groove 58 on a central side of the sheet tray 4. The second inner wall 58*b*2 is formed in a portion of the groove 58 on a side of the right side wall 50 of the sheet tray 4. The oblique inner wall 58*b*3 is formed to smoothly connect the first inner wall 58*b*1 and the second inner wall 58*b*2 therebetween.

In the present embodiment, projecting amounts of the four protruding potions 66-69 are partially different. Specifically, as shown in FIG. 8, the two protruding potions 66 and 67, which are located on the central side of the sheet tray 4, and the protruding potion 69, which is located on the side of the right side wall 50 and faces the front inner wall 58*a*, have a same projecting amount L1. The protruding potion 68, which is located on the side of the right side wall 50 of the sheet tray 4 and faces the second inner wall 58*b*2, has a projecting amount L2 smaller than the projecting amount L1 (L1>L2).

Accordingly, a distance (hereinafter also referred to as a "second distance b") between end surfaces of the two protruding potions 68 and 69 located on the side of the right side wall 50 of the sheet tray 4 is smaller than a distance (hereinafter also referred to as a "first distance a") between end surfaces of the two protruding potions 66 and 67 located on the central side of the sheet tray 4 (a>b).

The first distance a of the two protruding potions 66 and 67 located on the central side of the sheet tray 4 is the same as or slightly smaller than the second width W2 between the front inner wall 58*a* and the second inner wall 58*b*2. Accordingly, the two protruding potions 66 and 67 are slidable between the front inner wall 58*a* and the second inner wall 58*b*2. The sheet tray 4 and the right side guide 54 are formed by injection molding of synthetic resin in the present embodiment. In view of manufacturing tolerances during injection molding and other conditions, a difference between the first distance a and the second width W2 is designed to be as small as possible even though a relatively large sliding resistance may be resulted.

Accordingly, the first width W1 is the largest, while the second distance b is the smallest (W1>W2≧a>b). The first distance a and the second distance b may be the same (W1>W2≧a≧b). The second distance b is preferably smaller than the first distance a in order to allow easier insertion of the sliding portion 64 between the front inner wall 58*a* and the second inner wall 58*b*2 when the right side guide 54 is slid. A difference between the first distance a and the second distance b is also preferably small.

The four protruding potions 66-69 include non-angular corners (circular arc corners in the present embodiment) 66*a*-69*a*, respectively, formed in respective side surfaces.

The sliding portion 64 includes one end portion 73 which is located on a reverse side of the bottom wall 44 when the sliding portion 64 is inserted into the groove 58. The one end portion 73 is provided with a plurality of slip preventing projections 70-72 which project in the sheet conveying direction of the sheets P or in the opposite direction (total three in the present embodiment, i.e., two in the sheet conveying direction and one in the opposite direction as shown in FIG. 7). The one end portion 73 is thus partially wider than the first width W1 of the groove 58 by the slip preventing projections 70-72.

When the sliding portion 64 is inserted into the groove 58, the slip preventing projections 70-72 engage with the reverse surface of the bottom wall 44. Accordingly, the bottom wall 44 is held in a sandwiched manner by the horizontal wall 60 and the slip preventing projections 70-72, and thereby the sliding portion 64 of the right side guide 54 is prevented from slipping out of the groove 58.

A plate-like rack portion 74 extends from the sliding portion 64 in parallel with the bottom wall 44 toward the central side of the sheet tray 4. The sliding portion 64 and the plate-like rack portion 74 are integrally formed. As shown in FIG. 7, the rack portion 74 includes rack teeth 76 formed in an end face thereof in the sheet feeding direction of the sheets P. The rack teeth 76 engage with a pinion 78 rotatably held by the bottom wall 44.

The groove 58 includes a pair of cutouts 80 and 82 formed in the first inner wall 58*b*1 and the front inner wall 58*a*, respectively. The cutouts 80 and 82 have sizes which allow the slip preventing projections 70-72 to pass therethrough.

To insert the sliding portion 64 into the groove 58, the right side guide 54 is first tilted to insert the rack portion 74 into the groove 58. Then, the pair of slip preventing projections 70 and 71 located on the central side of the sheet tray 4 are passed through the cutouts 80 and 82. Subsequently, the slip preventing projection 72 located on the side of the right side wall 50 is passed through the cutout 82 as shown by two-dotted chain lines in FIG. 7. Thus, the horizontal wall 60 is brought into parallel with the bottom wall 44, and thereby the protruding potions 66-69 of the sliding portion 64 become slidable on the side walls 58*a* and 58*b* of the groove 58.

The cutouts 80 and 82 are located on a further central side of the sheet tray 4 from a position of the sliding portion 64 when the right side guide 54 is adjusted corresponding to a width of the sheets P of a smallest size.

The left side guide 52 having a symmetrical configuration to the right side guide 54 includes a horizontal wall 84 and a vertical wall 86 in a same manner as the right side guide 54. The left side guide 52 includes a sliding portion 87, four protruding potions 88-91, slip preventing projections 92-94 and a rack portion 98 on a side of the bottom wall 44 of the horizontal wall 84, that is, on an under side of the horizontal wall 84. The rack portion 98 includes rack teeth 96 formed in an end face thereof in a direction opposite to the sheet feeding direction.

In the present embodiment, both of the rack portions 74 and 98 and the pinion 78 constitute a cooperating mechanism 100. The cooperating mechanism 100, however, may be provided according to need. While the left side guide 52 and the right side guide 54 are provided in the present embodiment, it may be possible, for example, to provide only the right side guide 54 which is slidable. In this case, the left side wall 48 may be designed to also serve as a left side guide. The sheet tray 4 need not have a box-shaped configuration, but may have a flat plate-like configuration. The sheet tray 4 need not be attachable to and detachable from the image forming apparatus 1.

The groove 56 on the left side in the pair of grooves 56 and 58 formed in the bottom wall 44 includes a front inner wall 56*a* and a back inner wall 56*b* in a same manner as the groove 58 formed on the right side. The back inner wall 56*b* includes a first inner wall 56*b*1, a second inner wall 56*b*2 and an oblique inner wall 56*b*3.

The left side wall 48 and the right side wall 50 of the sheet tray 4 are parallel with end surfaces of the sheet abutting portions 62*a* (only the sheet abutting portions 62*a* on the vertical wall 62 are shown) of the vertical walls 86 and 62 of the left side guide 52 and the right side guide 54, respectively.

The left side wall 48 and the right side wall 50 are provided with cutouts 48*a* and 50*a*, respectively. The cutouts 48*a* and 50*a* have smaller heights than the respective vertical walls 86 and 62 of the left side guide 52 and the right side guide 54. Since the vertical walls 86 and 62 of the left side guide 52 and the right side guide 54 are exposed through the cutouts 48*a* and 50*a*, respectively, the vertical walls 86 and 62 may be pushed with a finger from outside the left side wall 48 and the right side wall 50 of the sheet tray 4.

Inside the sheet tray 4, a rear guide member 102 is provided so as to abut a side face of the sheets P opposite to the sheet conveying direction. The rear guide member 102 projects from the bottom wall 44 such that a position of the rear guide member 102 may be adjustable along the sheet conveying direction.

A description will now be provided on an operation of the image forming apparatus in the above-described embodiment along with a procedure of setting the sheets P in the sheet tray 4.

First, to set the sheets P in the sheet tray 4, the left side guide 52 and the right side guide 54 are moved toward the left side wall 48 and the right side wall 50, respectively, of the sheet tray 4. Then, the sheets P are placed between the vertical walls 86 and 62. In this case, the left side guide 52 and the right side guide 54 cooperatively move the same distance toward the left side wall 48 and the right side wall 50, respectively, due to the cooperating mechanism 100.

When the sheets P are of A4 size or letter size, the left side guide 52 and the right side guide 54 are moved most toward the left side wall 48 and the right side wall 50, respectively.

Since the first width W1 of the groove 58 is larger than the first distance a and the second distance b, the protruding potions 66-69 of the right side guide 54 are slidable with a relatively small sliding resistance in an area of the groove 58 having the first width W1. In the same manner, the protruding potions 88-91 the left side guide 52 are slidable with a relatively small sliding resistance between the front inner wall 56*a* and the first inner wall 56*b*1 of the groove 56.

When the right side guide 54 is further moved toward the right side wall 50 of the sheet tray 4, the protruding potions

66-69 of the right side guide 54 continuously slide between the front inner wall 58*a* and the first inner wall 58*b*1. Subsequently, the protruding potions 66-69 pass between the front inner wall 58*a* and the oblique inner wall 58*b*3, and enter between the front inner wall 58*a* and the second inner wall 58*b*2.

Specifically, as described above, the second distance b of the two protruding potions 68 and 69 located on the side of the right side wall 50 of the sheet tray 4 is smaller than the first distance a, and thus smaller than the second width W2 between the front inner wall 58*a* and the second inner wall 58*b*2. Accordingly, when the right side guide 54 is moved toward the right side wall 50 of the sheet tray 4, the protruding potions 68 and 69 may enter between the front inner wall 58*a* and the second inner wall 58*b*2 along the oblique inner wall 58*b*3 relatively smoothly even if the second width W2 is small. In other words, an improved operability may be achieved by providing the second distance b smaller than the first distance a.

When the right side guide 54 is still further moved toward the right side wall 50 of the sheet tray 4, the sliding portion 64 slides further toward the right side wall 50 of the sheet tray 4 along the groove 58. The two protruding potions 66 and 67 located on the central side of the sheet tray 4 pass between the front inner wall 58*a* and the oblique inner wall 58*b*3, and then enter between the front inner wall 58*a* and the second inner wall 58*b*2.

When the two protruding potions 66 and 67 located on the central side of the sheet tray 4 enter between the front inner wall 58*a* and the second inner wall 58*b*2, a sliding resistance occurs. The sliding resistance is larger than before the protruding potions 66 and 67 enter between the front inner wall 58*a* and the second inner wall 58*b*2 since the first distance a is the same or only slightly smaller than the second width W2.

The same is applicable to the left side guide 52. When the left side guide 52 is slid toward the left side wall 48 of the sheet tray 4 and the protruding potions 88 and 89 enter between the front inner wall 56*a* and the second inner wall 56*b*2, a sliding resistance larger than before the protruding potions 88 and 89 enter between the front inner wall 56*a* and the second inner wall 56*b*2 occurs.

The left side guide 52 and the right side guide 54 are moved against the sliding resistances to respective positions separated by a distance slightly larger than the width of the sheets P of A4 size, and then the sheets P of A4 size are set therebetween.

Subsequently, the sheet abutting portions 62*a* (only the sheet abutting portions 62*a* on the vertical wall 62 are shown) of the vertical walls 86 and 62 of the left side guide 52 and the right side guide 54 are abutted against side surfaces of the sheets P. Specifically, the vertical walls 86 and 62 are pushed by fingers from outside the sheet tray 4 through the cutouts 48*a* and 50*a* to be moved to respective positions corresponding to the width of the sheets P. Although relatively large sliding resistances may occur, the cutouts 48*a* and 50*a* allow the side guides 52 and 54 to be pushed through the cutouts 48*a* and 50*a* thereby to be properly positioned easily. That is, a good operability of the side guides 52 and 54 may be achieved.

After the left side guide 52 and the right side guide 54 are adjusted to the width of the sheets P, the sheet tray 4 is inserted from the opening 2*a* and is attached in the housing 2. Then, in response to an input through the operation buttons 30*a*, the sheet feed roller 12 and the regist rollers 34 and 36 are driven to convey an uppermost sheet of the sheets P stacked in the sheet tray 4.

When the sheets P of A4 size are to be conveyed from the sheet tray 4, the protruding potions 88-91 of the left side guide 52 are fitted between the front inner wall 56*a* and the second inner wall 56*b*2 with only a narrow gap. Also, the protruding potions 66-69 of the right side guide 54 are fitted between the front inner wall 58*a* and the second inner wall 58*b*2 with only a narrow gap.

Accordingly, the sheet abutting portions 62*a* (only the sheet abutting portions 62*a* on the vertical wall 62 are shown) of the vertical walls 86 and 62 of the left side guide 52 and the right side guide 54 may be located accurately in parallel with the sheet conveying direction. Also, the left side guide 52 and the right side guide 54 may be securely held even when an external force is applied, and thereby the vertical walls 86 and 62 may be suppressed from being obliquely deviated from the sheet conveying direction.

Therefore, abutment of the sheet abutting portions 62*a* against side surfaces of the sheets P allows the sheets P to be stacked in a specific direction, i.e., such that a longitudinal direction of the sheets P is accurately parallel with the sheet conveying direction. Thus, each of the sheets P stacked in the sheet tray 4 may be conveyed from the sheet tray 4 without oblique movement deviated from the sheet conveying direction.

The image forming apparatus 1 of the present embodiment has the continuous sheet feed mode as described above. When the sheets P are conveyed in the continuous sheet feed mode, elimination of oblique movement by the regist roller 34 and 36 is not performed. However, oblique movement of the sheets P is suppressed by the sheet tray 4 and the side guides 52 and 54 as described above. Accordingly, even when the sheets P are continuously conveyed in the continuous sheet feed mode, oblique movement of the sheets P may be suppressed and clear printing may be achieved.

To set sheets P of B5 size in the sheet tray 4, for example, in a case of changing from A4 size to B5 size, the sheets P of A4 size are removed and the sheets P of B5 size are set in an approximate central portion of the sheet tray 4. Subsequently, the left side guide 52 and the right side guide 54 are moved in accordance with the width of the sheets of B5 size.

In this case, the two protruding potions 66 and 67 of the right side guide 54 located on the central side of the sheet tray 4 come out between the front inner wall 58*a* and the second inner wall 58*b*2, pass between the front inner wall 58*a* and the oblique inner wall 58*b*3, and then enter between the front inner wall 58*a* and the first inner wall 58*b*1. The two protruding potions 68 and 69 located on the side of the right side wall 50 followingly come out between the front inner wall 58*a* and the second inner wall 58*b*2, pass between the front inner wall 58*a* and the oblique inner wall 58*b*3, and then enter between the front inner wall 58*a* and the first inner wall 58*b*1.

Once the protruding potions 66-69 enter between the front inner wall 58*a* and the first inner wall 58*b*1, the sliding resistance becomes smaller since the first width W1 is larger than the first distance a and the second distance b. Accordingly, the right side guide 54 may be moved easily. The same is applicable to the left side guide 52. When sliding resistances to move the left side guide 52 and the right side guide 54 are large at the beginning of movement, the vertical walls 86 and 62 may be pushed by fingers through the cutouts 48*a* and 50*a*.

In the image forming apparatus 1 of the present embodiment, as described above, when the side guides 52 and 54 are adjusted to a sheet width of at least one size (A4 size in the present embodiment), the sliding portions 87 and 64 of the side guides 52 and 54 are located in areas having a groove width of the second distance W2 smaller than the first distance W1. Accordingly, the side guides 52 and 54 are suppressed from being deviated, and thereby oblique movement of the sheets P may be suppressed. At the same time, the side guides 52 and 54 may be easily slidable since the first distance W1 is larger than the first distance a and the second distance b.

Since the protruding potions 88-91 and 66-69 have circular arc corners 88*a*-91*a* and 66*a*-69*a*, the side guides 52 and 54 may be easily slid in the area having the groove width of the second distance W2. While the protruding potions 88-91 and 66-69 have circular arc corners 88*a*-91*a* and 66*a*-69*a* in the present embodiment, the protruding potions 88-91 and 66-69 may have chamfered corners.

Also, it may be easy to manufacture the sheet tray 4 provided with the grooves 56 and 58 each having an only partially different width. In addition, the sliding portions 87 and 64 provided with the protruding potions 88-91 and 66-69, respectively, may be smoothly slidable in the grooves 56 and 58.

Further, the different projecting amounts of the plurality of protruding potions 88-91 and 66-69 may lead to improved operabilities of the side guides 52 and 54. Still further, the cooperating mechanism 100 that allows cooperative movement of the side guides 52 and 54 may lead to improved operabilities of the side guides 52 and 54.

The cutouts 48*a* and 50*a* provided in the side walls 48 and 50, respectively, of the sheet tray 4 may facilitate easy operation of the side guides 52 and 54.

Figure 9:
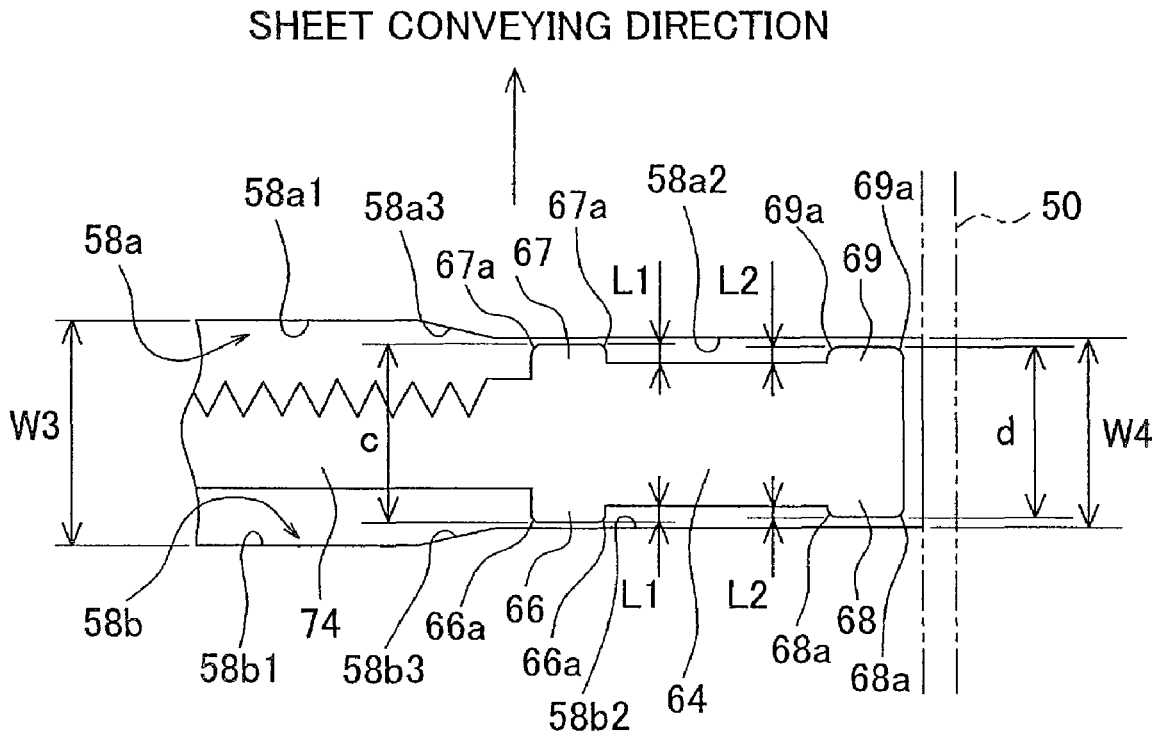
FIG. 9 an enlarged explanatory view showing a relationship between protruding amounts of protruding potions of a sliding portion of a right side guide in another embodiment and the width of the groove.

The relationship between the projecting amounts of the protruding potions of the sliding portions of the side guide and the width of the groove is not limited to one defined by the above-described protruding potions 66-69 and the groove 58. For example, the front inner wall 58*a* may have a first inner wall 58*a*1, a second inner wall 58*a*2 and an oblique inner wall 58*a*3 in the same manner as the back inner wall 58*b*, as shown in another embodiment in FIG. 9.

In this case, a distance between the second inner wall 58*a*2 and the second inner wall 58*b*2 (hereinafter also referred to as a "fourth width W4") is smaller than a distance between the first inner wall 58*a*1 and the first inner wall 58*b*1 (hereinafter also referred to as a "third width W3") Each of the two protruding potions 68 and 69 located on the side of the right side wall 50 has the projecting amount L2, while each of the two protruding potions 66 and 67 located on the central side of the sheet tray 4 has the projecting amount L1. Here, a distance between the end surfaces of the protruding potions 66 and 67 is referred to as a third distance c, and a distance between the end surfaces of the protruding potions 68 and 69 is referred to as a fourth distance d. Then, there may be a relationship indicated by $W3>W4\geqq c>d$, or $W3>W4\geqq c\geqq d$.

It is to be understood that the present invention should not be limited to the above described embodiments, but may be embodied in various forms without departing from the spirit and scope of the present invention.

For example, the side guide in the present invention may be applied to the rear guide member 102 in the above described embodiment. Specifically, the rear guide member 102 may be configured in a same manner as the side guide 52 or 54, and a groove extending in the sheet conveying direction of the sheets P may be provided in the bottom wall 44 in a same manner as the groove 58 or 56 so as to allow a sliding portion to be slid in the groove.

What is claimed is:

1. A sheet guide apparatus, comprising:

a sheet tray in which a sheet is placed; and a side guide having at least one abutting portion that abuts one of edges of the sheet placed in the sheet tray, wherein the sheet tray includes a groove formed along a direction perpendicular to an abutting surface of the abutting portion against the sheet, wherein the side guide includes a sliding portion having slidable portions configured to slide on a pair of opposed side walls of the groove, at least one first slip preventing projection positioned at a first end of the sliding portion and at least two second slip preventing projections positioned at a second end of the sliding portion, wherein the first end is closer to the at least one abutting portion than the second end, and the side guide is configured to move along a groove direction as a longitudinal direction of the groove when the sliding portion is slid on the side walls, and wherein the groove includes two cutouts, at least one first groove area and at least one second groove area positioned directly adjacent to the first groove area, wherein the two cutouts are configured to allow the slip preventing projections to pass therethrough, and the at least one second groove area has a groove width smaller than a groove width of the at least one first groove area and allows the slidable portions of the sliding portion to be slid in the second groove area, and wherein the at least one first slip preventing projection and the at least two second slip preventing projections are configured to only pass through the two cutouts, and wherein the at least one first and the at least two second slip preventing projections are configured to prevent the sliding portion from separating from the groove when the at least one first and the at least two second slip preventing projections are at positions along the groove away from the two cutouts of the groove.

2. The sheet guide apparatus according to claim 1, wherein the abutting surface is formed in parallel with a conveying direction of the sheet, and wherein the side guide guides the sheet in the conveying direction by means of the abutting portion abutting at least one of the edges of the sheet.

3. The sheet guide apparatus according to claim 2, wherein the sheet guide apparatus includes two side guides, and wherein the at least one abutting portion of each of the two side guides is arranged such that the abutting surface against the sheet faces each other and is in parallel with each other.

4. The sheet guide apparatus according to claim 3, further comprising: a cooperating mechanism that displaces a second side guide of the two side guides, when a first side guide of the two side guides is displaced in one direction, simultaneously in as direction opposite to the one direction.

5. The sheet guide apparatus according to claim 2, wherein the at least one abutting portion is a plurality of abutting portions, and wherein the plurality of abutting portions are provided at predetermined intervals along the conveying direction.

6. The sheet guide apparatus according to claim 1, wherein one of the at least one second groove area is an area in which the sliding portion is located when the at least one abutting portion abuts a sheet of a specified size placed in the sheet tray.

7. The sheet guide apparatus according to claim 6, wherein the sheet of the specified size is a sheet of a maximum size among sheets of various sizes capable of being placed in the sheet tray.

8. The sheet guide apparatus according to claim 1, wherein one of the at least one second groove area is provided at one of both ends of the groove in the groove direction.

9. The sheet guide apparatus according to claim 1, wherein the at least one second groove area and the at least one first groove area are connected such that the groove width of the at least one second groove area smoothly changes to the groove width of the at least one first groove area.

10. The sheet guide apparatus according to claim 1, wherein the sliding portion includes two end parts in the groove direction, at least one of the two end parts having at least one of a rounded corner and a chamfered corner formed in side surfaces of the sliding portion.

11. The sheet guide apparatus according to claim 1, wherein the sliding portion has varying widths along the groove direction, and wherein a width of at least one of two end parts of the sliding portion in the groove direction is larger than widths of remaining parts of the sliding portion.

12. The sheet guide apparatus according to claim 1, wherein the sliding portion includes a pair of surfaces facing the side walls of the groove and at least one protruding portion protruding from at least one of the pair of surfaces, and wherein at least one end surface of the protruding portion is adapted to be slid on a side wall of the at least one second groove area.

13. The sheet guide apparatus according to claim 12, wherein the at least one protruding portion, is a plurality of protruding portions, and wherein at least one of the plurality of protruding portions has a protruding amount different from protruding amounts of the other protruding portions.

14. The sheet guide apparatus according to claim 13, wherein a protruding amount of a protruding portion, which is located most close to the sheet to be placed among the plurality of protruding portions, is larger than protruding amounts of the other protruding portions.

15. The sheet guide apparatus according to claim 13, wherein two protruding portions of the plurality of protruding portions are provided at two end parts of the sliding portion in the groove direction.

16. The sheet guide apparatus according to claim 1, wherein the sheet tray further includes a side wall that is located on a side of the at least one abutting portion opposite to a facing direction of the abutting surface of the abutting portion, and is parallel with the abutting surface.

17. The sheet guide apparatus according to claim 16, wherein the side guide includes a plate member that is parallel with the side wall of the sheet tray; and wherein the at least one abutting portion is provided to the plate member.

18. The sheet guide apparatus according to claim 17, wherein at least a part of the side wall of the sheet tray has a smaller height than the plate member.

19. The sheet guide apparatus according to claim 1, wherein the two cutouts are disposed along one portion of the groove in the longitudinal direction.

20. An image forming apparatus, comprising:

at least one sheet guide apparatus according to claim 1;

a printing mechanism that forms an image on the sheet; and a conveying mechanism that conveys the sheet placed in the sheet guide apparatus to the printing mechanism.

* * * * *